United States Patent [19]

Ohmatsu

[11] Patent Number: 4,956,955

[45] Date of Patent: Sep. 18, 1990

[54] EXPANSION JOINT DEVICE FOR USE IN INTERIOR DESIGNS

[76] Inventor: Toshikazu Ohmatsu, 178-1 Bonsai-cho, Ohmiya, Saitama, Japan

[21] Appl. No.: 315,059

[22] Filed: Feb. 24, 1989

[51] Int. Cl.[5] ..... E04B 1/68

[52] U.S. Cl. ..... 52/396; 52/573; 404/52; 404/56

[58] Field of Search ..... 52/396, 573, 395, 109; 404/47, 52, 53, 54, 55, 56, 57, 58, 59, 67, 68, 69, 74

[56] References Cited

U.S. PATENT DOCUMENTS

| | | | |
|---|---|---|---|
| 3,371,456 | 3/1968 | Balzer et al. | 52/396 X |
| 3,390,501 | 7/1968 | Driggers | 52/396 X |
| 3,417,528 | 12/1968 | Hallock | 52/396 X |
| 4,063,839 | 12/1977 | Brown | 52/396 X |
| 4,833,851 | 5/1989 | Ohmatsu | 52/396 |

*Primary Examiner*—David A. Scherbel
*Assistant Examiner*—Creighton Smith
*Attorney, Agent, or Firm*—Schwartz & Weinrieb

[57] ABSTRACT

An expansion joint cover assembly includes base frame members secured to building sections having an expansion joint gap defined therebetween. Cover frame members are secured to the base frame members in such a manner as to define cavities therebetween, and opposite side edge portions of a covering connecting plate are slidably disposed within the cavities so as to cover the expansion joint gap defined between the building sections under expansion and contraction conditions. The cover frame members further include channel sections for housing edge portions of interior design material panels, for example, ceiling panels, wall panels, and the like.

13 Claims, 2 Drawing Sheets

EXPANSION JOINT DEVICE FOR USE IN INTERIOR DESIGNS

FIELD OF THE INVENTION

The present invention relates generally to expansion joints, and more particularly to an expansion joint cover structure for covering a gap so as to effectively absorb expansions and contractions which occur within building structures. Still further, the present invention relates to an improvement in an expansion joint cover structure which covers the gaps defined between interior building structures, such as, for example, ceiling surface sections, interior wall surface sections, and at the intersections of the ceiling and interior wall surfaces.

BACKGROUND OF THE INVENTION

Buildings are always subjected to stress and strain forces due to expansion and contraction conditions attendant environmental temperatures, irregular foundation conditions, and distortion forces generated, for example, by means of earthquakes. It has therefore been conventional practice, when erecting interior building structures, to provide gap portions or regions between sections of the interior building structures so as to effectively absorb or accommodate the expansion and contraction conditions occurring within the building, thereby effectively preventing destruction of the building, or regions thereof, as a result of the existence of such expansion and contraction conditions and the forces, stresses, and strains generated thereby.

Accordingly, in connection with the finishing or completion of the interior structures of buildings, the aforenoted gap portions must be covered by means of expansion joint covers which can in fact accommodate both expansion and contraction conditions. As illustrated within FIG. 3, there is disclosed a conventional expansion joint system which includes a cover plate 51 which is engaged upon a pair of laterally spaced edge frames 50 which are, in turn, fixed to end portions a,a of two buildings separated by means of a gap G. Free edge portions of a pair of laterally spaced ceiling sections or plates b,b are disposed upon laterally outward support surfaces 54 of the edge frames 50, and the cover plate 51, which is of the flat plate type having a width sufficiently large enough to encompass the edge frames 50 and also engage opposite surfaces of the ceiling sections or plates b,b, and thereby accommodate any expansion and contractions conditions attendant gap G, is fixed to a suspended metal fixture 52, expansibly interposed between the laterally spaced edge frames 50,50, by means of a threaded bolt 53, whereby the gap G is in fact covered.

However, in accordance with the construction features of the conventional system shown in FIG. 3, and in particular with respect to the provision of the cover plate 51, the width W of the cover plate 51 is seen to be substantially larger than the width dimension of the gap G. Consequently, there developed the problem that the cover plate 51 extending along the expansion joint or gap G aesthetically divided the designs of the interior wall surfaces of the buildings, such as, for example, those of the ceiling panels, vertical wall panels, and the like. The problem has become particularly acute in connection with expansion joints or gaps G provided in connection with the construction of large office buildings, or high-rise buildings, whereby a sense of interior design incompatibility resulted in some cases.

OBJECT OF THE INVENTION

It is accordingly the primary object of the present invention to provide a new and improved expansion joint cover, for use in connection with interior structures, which effectively eliminates the foregoing problems characteristic of the prior art expansion joint systems, and which effectively renders the gap portions of the expansion joint substantially inconspicuous, whereby the improved expansion joint cover of the present invention is particularly desirable for use in connection with interior wall surfaces, ceiling surfaces, and the like.

SUMMARY OF THE INVENTION

In accordance with the foregoing and other objectives, the present invention comprises an expansion joint cover which includes a base frame member mounted upon the outer face of each one of the structural building sections, and a cover frame member fixedly secured respectively to each one of the base frame members with a cavity or slot defined therebetween. The edge region of each cover frame member which is disposed toward the gap defined between the building sections has a substantially C-shaped cross-section so as to house an edge portion of an interior material panel, such as, for example, a ceiling panel or a wall panel, and a covering connecting plate, having a width greater than the gap defined between the building sections, has its opposite side edge portions disposed within the cavities defined between the base frame members and the cover frame members upon opposite sides of the building section gap so as to bridge such gap and define an expansion joint with respect thereto.

In addition to the structural system of the present invention as defined above, wherein both building sections have their outer faces disposed, in effect, within a common or single plane, in the instance wherein the gap defined between building sections occurs between building sections having their outer faces disposed within substantially mutually orthogonal planes, such as, for example, when the building sections comprise a ceiling structure and a vertical wall structure, or still further, when the building structures comprise two vertical wall structures defining, in effect, a corner structure therebetween, the expansion joint cover of the present invention to be used for covering the gap defined between such building sections or structures includes, at the side edge portion of the covering connecting plate which is disposed toward the joint or corner gap, a frame member or portion which is pivotably connected to another frame member, mounted upon one of the building sections, so as to define a hinge mechanism therewith. In this manner, the angular disposition of the expansion joint covering connecting plate, covering the gap defined between the two building sections, can automatically adjust itself so as to accommodate any relative changes in the disposition of the building sections with respect to each other under expansion and contraction conditions.

In accordance with either one of the foregoing embodiments of the present invention, at least one end or side edge portion of the covering connecting plate is disposed within the cavity defined between the base frame member and the cover frame member so as to cover, span, or bridge the gap defined between the building sections in accordance with an adjustably slidable mode of operation. In addition, the cover frame members mount the interior material panel in an adjustably slidable mode so as to, in turn, accommodate any expansion and contraction conditions.

BRIEF DESCRIPTION OF THE DRAWINGS

Various other objects, features, and attendant advantages of the present invention will be more fully appreciated from the following detailed description, when considered in connection with the accompanying drawings, in which like reference characters designate like or corresponding parts throughout the several views, and wherein.

DETAILED DESCRIPTION OF THE ILLUSTRATED EMBODIMENTS

Figure 1:
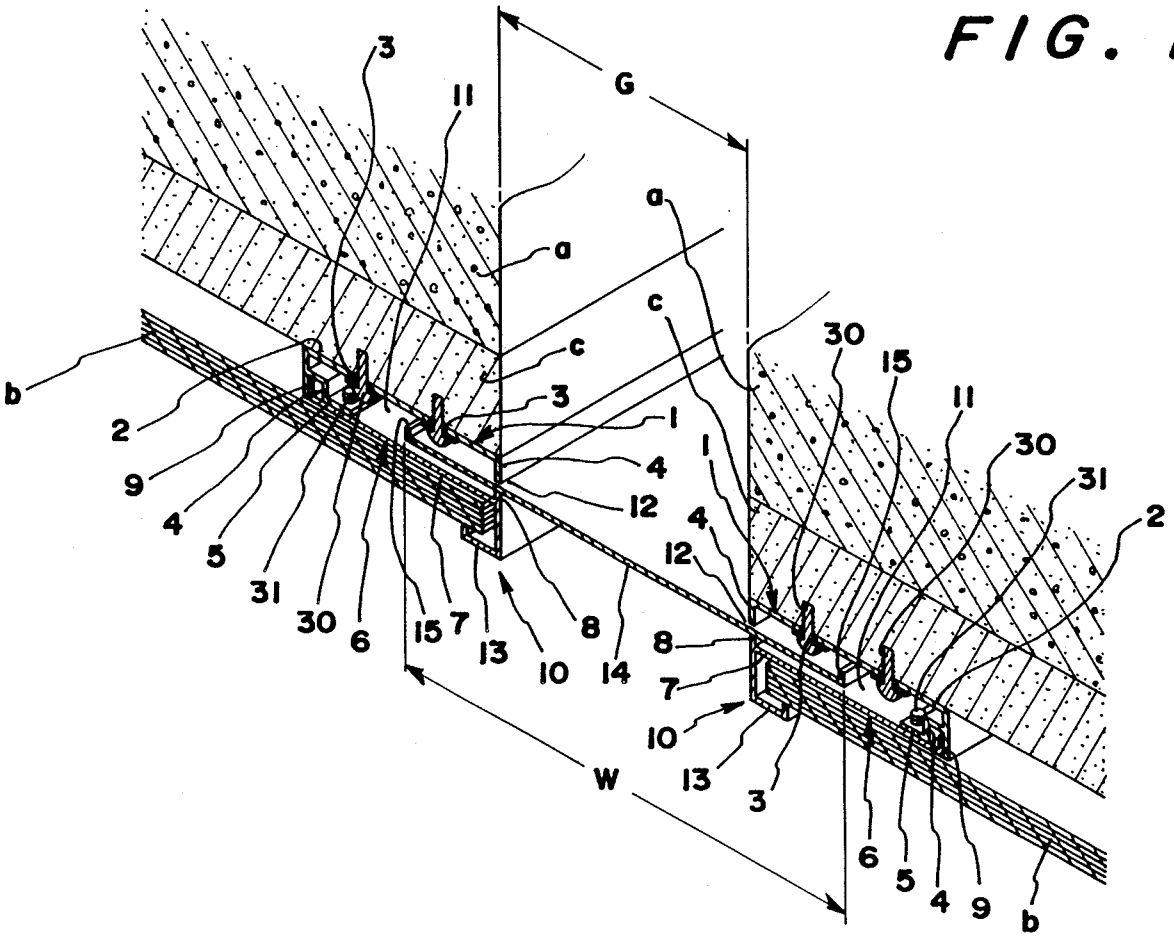
FIG. 1 is a perspective view, partly in cross-section, of a first embodiment of an expansion joint cover system for use in connection with the mounting of interior design material panels upon building structure sections having an expansion joint defined therebetween and constructed in accordance with the present invention.

Referring now to the drawings, and more particularly to FIG. 1 thereof, reference numerals 1,1 denote base frame members which are fixedly mounted upon each building section a disposed upon opposite sides of the expansion joint which defines a gap G therebetween, and more particularly, it is seen that the base frame members 1 are actually fixedly attached to structural members c, which, in turn, form inner surface regions of building sections a, by means of screws 30. The base frame members 1 have bottom plate portions 2 engaged upon the faces of the structural members c, and bottom plate portions 2 have outwardly projecting portions 4 disposed at the front edge regions thereof which are located along the respective edges of the structural members c defining the expansion joint gap G therebetween. Each bottom plate portion 2 further includes a small hole 3 for insertion of the attaching screw 30, and a channel-shaped portion 5, which defines a groove **4*a* therewithin, which serves a purpose which will become apparent shortly, provided at the opposite side region of plate portion 2 relative to front edge portion 4**.

The reference numeral 6 denotes a cover frame member which has a width dimension substantially equal to that of the associated base frame member 1, and it is seen that each cover frame member 6 includes a mounting plate portion 7 having an inwardly or upwardly projecting front edge region 8 which is disposed in a spaced relationship with respect to the outwardly projecting front edge portion or region 4 of the bottom plate portion 2 of base frame member 1 so as to define a longitudinally extending slit gap 12, the purpose of which will also become apparent shortly. Each mounting plate portion 7 also includes an upstanding edge portion 9 provided along a side edge portion of plate portion 7 which is disposed opposite front edge region 8, and it is seen that upstanding edge portion 9 is disposed within the groove **4*a* of channel-shaped portion 5 of the base frame bottom plate portion 2. The cover frame member 6 is thus secured to and mounted upon the base frame member 1 as a result of the engaging disposition of the upstanding edge portion 9 within the groove 4*a*, the assembly being fixed together by means of a screw 31 so as to define with each other frame assemblies generally designated by the reference characters 10. As can be additionally appreciated from FIG. 1, bottom plate portion 2 of base frame member 1 is spaced from mounting plate portion 7 of cover frame member 6 so as to define therebetween a cavity 11, entry into which is achieved through means of the aforenoted longitudinally extending slit gap 12** as will become more apparent hereinafter.

Mounting plate portion 7 of cover frame member 6 is further provided with an outwardly projecting or downwardly extending portion 23 so as to extend in a direction opposite to that of front edge region 8, and at the free end of portion 23, there is further provided a surface member 13, which is disposed substantially perpendicular to portion 23 such that plate portion 7, projecting portion 23, and member 13 form a substantially C-shaped cavity or pocket within which an interior design material panel b, such as, for example, a ceiling plate or panel, or an inner wall plate or panel, can have an edge portion thereof housed.

A covering connecting plate 14 completes the expansion joint cover system of the present invention, and plate 14 is seen to extend across the gap G defined between the building sections a such that opposite side edge regions of plate 14 are disposed through the slits 12 defined between the base frame members 1 and the cover frame members 6 whereby the opposite side edge regions of plate 14 are disposed within cavities 11. The plate 14 is of course provided with a width dimension W which is sufficiently greater than the width of the gap G defined between the building sections a such that the side edge regions of plate 14 are not only disposed within the cavities 11, as illustrated, but more importantly, such side edge regions of plate 14 will remain within the cavities 11 regardless of any change in the width dimension of gap G which may result in connection with varying expansion and contraction conditions. In connection with such movement of the covering connecting plate 14 relative to the base frame members 1 and the cover frame members 6, and in order to insure that the side edge regions of plate 14 in fact remain or are retained within the cavities 11 defined between the base frame members 1 and the cover frame members 6, the oppositely disposed side edge regions of plate 14 are further provided with upstanding rib portions or members 15 which are adapted to engage dependent front edge portions 4 of base frame members 1 so as to limit the movement of the side edge regions of plate 14 out of cavities 11 through means of the longitudinally extending slit gaps 12.

In order to actually assemble the expansion joint cover of the present invention, which is particularly useful in connection with the mounting of interior design material panels, the base frame members 1 are initially secured to the building structure members c by means of the screws 30, and subsequently, the covering connecting plate 14 is disposed over the front edge portions 4 of the base frame members 1. The cover frame membes 6 are then secured to the base frame members 1 by means of the screws 31, the covering connecting plate 14 therefore being slidable relative to base frame members 1 and cover frame members 6 in such a manner that the side edge regions of plate 14 are freely slidable through the slit gaps 12 defined between the front edge portions 4 of the base frame members 1 and the front edge regions 8 of the cover frame members 6. Side edge portions of the interior design material panels b are of course disposed within the substantially C-shaped channels formed by plate portions 7, projecting portions 23, and members 13 of the cover frame members 6 whereby such panels b, which may be, for example, ceiling panels, vertical wall panels, or the like, are secured within the regions of the expansion joints.

Figure 2:
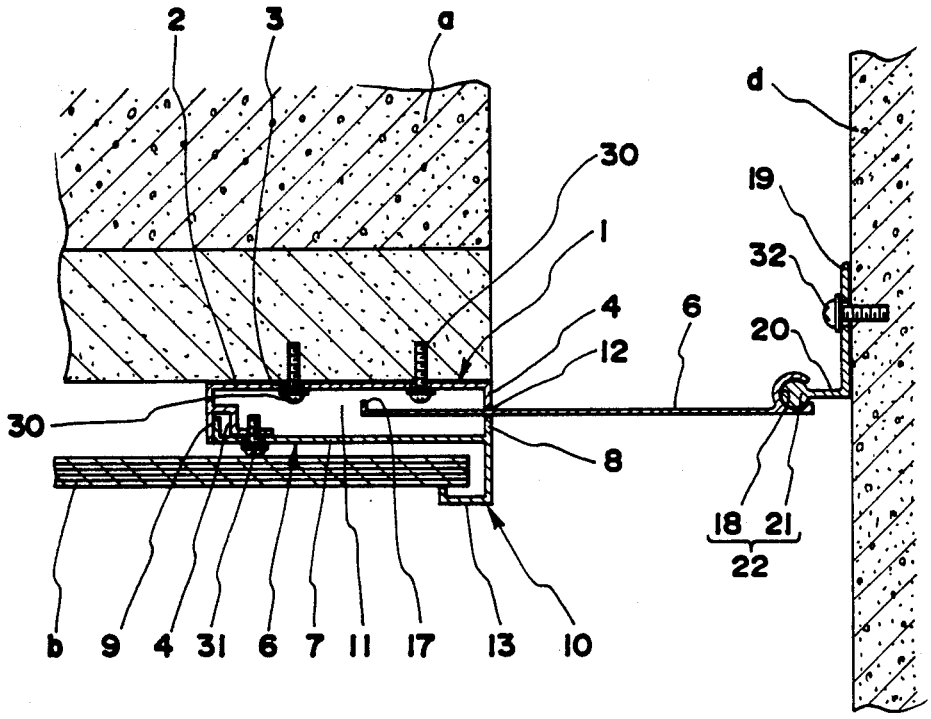
FIG. 2 is a vertical cross-sectional view of a second embodiment of an expansion joint cover system for use in connection with the mounting of interior design material panels upon building structure sections having an expansion joint gap defined therebetween and constructed in accordance with the present invention.
Figure 3:
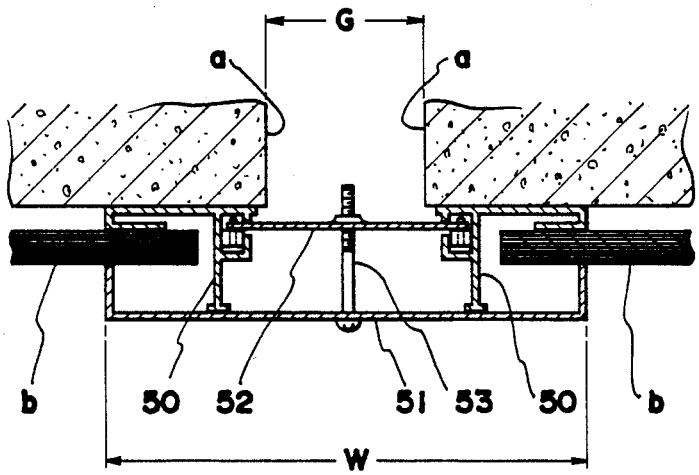
FIG. 3 (Prior Art)
FIG. 3, is a vertical cross-sectional view of a conventional PRIOR ART expansion joint cover system for use in connection with the mounting of interior design material panels upon building structure sections having an expansion joint gap defined therebetween.

Referring now to FIG. 2 of the drawings, a second embodiment of the present invention is disclosed wherein this particular embodiment of the invention is especially adapted for use in covering expansion joints defined between wall surfaces disposed at mutually orthogonal angles with respect to each other, such as, for example, may be defined between a ceiling surface and a vertical wall, or between two vertical walls at a corner junction thereof, and the like. Since the general structure of this embodiment is similar to that of the first embodiment disclosed within FIG. 1, the following description will be limited to those portions of the second embodiment of the present invention of FIG. 2 which are basically different from the structural components of the first embodiment of the present invention as illustrated in FIG. 1.

More particularly, the reference numeral 16 designates a covering connecting plate having an upstanding rib portion 17 defined at the left end thereof as viewed in the drawing figure, such rib portion 17 being similar to the rib portions 15 of the first embodiment in that the same cooperates with dependent front edge portion 4 of base frame member 1 so as to prevent withdrawal of plate 16 from cavity 11 through means of slit gap 12. Upon the right end of covering conneting plate 16, there is provided a hinge mechanism generally designated by the reference character 22, and the latter is seen to comprise a longitudinally extending, substantially C-shaped hinge socket 18 integrally formed as a single piece with plate 16. A mounting bracket 19, having a substantially L-shaped configuration, is fixedly secured upon a wall structure d by means of screw fasteners 32, and one leg portion of the bracket 19 is provided with a longitudinally extending beaded edge portion 21 which is pivotably received within the socket 18 of covering connecting plate 16. In this manner, relative pivotable movement of covering connecting plate 16 with respect to the mounting bracket 19 is achieved by means of the pivotable interconnection defined between socket 18 and beaded edge portion 21.

In connection with the actual assembly of the expansion joint cover of this embodiment of the present invention, the base frame member 1 is secured to the building section c by means of screws 30, the left end section of covering connecting plate 16, with the rib portion 17 formed thereon, is then disposed over member 1, and subsequently, cover frame member 6 is secured to base frame member 1 by means of screws 31 such that the ribbed end of covering connecting plate 16 is disposed within cavity 11. The beaded edge portion 21 of the bracket 19 is then inserted within the C-shaped socket 18 of covering connecting plate 16, and subsequently, bracket 19 is fixedly secured to wall structure d by means of screws 32.

As described in accordance with the foregoing, and as constructed in accordance with the present invention, the expansion joint cover of the present invention controls the exposure of the covering connecting plate to a width dimension which is substantially identical to the width dimension of the gap G defined between the two building structures under varying expansion and contraction conditions. In addition, the expansion joint cover assembly of the present invention includes means for mounting interior design material panels, such as, for example, ceiling panels, vertical wall panels, and the like, within the immediate vicinity of the expansion joint gap G, such that any visual or aesthetic discontinuity defined between adjacent interior design material panels, such as, for example, by means of the expansion joint defined between adjacent panels, is effectively minimized.

Obviously, many modifications and variations of the present invention are possible in light of the above teachings. It is therefore to be understood that within the scope of the appended claims, the present invention may be practiced otherwise than as specifically described herein.

What is claimed is:

1. An expansion joint for mounting building panels within the vicinity of an expansion joint gap defined between two building structures, comprising:
   - base frame members secured to said two building structures;
   - cover frame members secured to said base frame members in spaced relationship with respect thereto so as to define cavities therebetween;
   - an expansion joint covering plate having a width greater than said gap defined between said two building structures and having opposite side edge portions thereof slidably disposed within said cavities so as to cover said gap defined between said two building structures under expansion and contraction conditions; and
   - channel means provided upon said cover frame members for housing side edge portions of said building panels in order to mount said building panels upon said building structures.

2. An expansion joint as set forth in claim 1, wherein: said building panels comprise building material means for forming interior wall panels to be used within said building structures.

3. An expansion joint as set forth in claim 1, wherein: said base frame members have flange means projecting outwardly away from said building structures;
   - said cover frame members have flange means disposed opposite said flange means of said base frame members, and projecting toward said building structures, so as to define with said flange means of said base frame members slit gaps within which said opposite side edge portions of said expansion joint covering plate are slidably disposed; and
   - flange means provided upon said opposite side edge portions of said expansion joint covering plate for engaging at least one of said flange means of said base frame members and said cover frame members so as to retain said opposite side edge portions of said expansion joint covering plate within said cavities.

4. An expansion joint as set forth in claim 1, wherein: said channel means of said cover frame members have a substantially C-shaped configuration in cross-section.

5. An expansion joint as set forth in claim 1, wherein:
said two building structures have surfaces, upon which said base frame members are secured, which are disposed in a common place extending across said expansion joint gap.

6. An expansion joint for mounting a building panel within the vicinity of an expansion joint gap defined between two building structures, comprising:
a base frame member secured to one of said two building structures;
a cover frame member secured to said base frame member in spaced relationship with respect thereto so as to define a cavity therebetween;
an expansion joint covering plate having a width greater than said gap defined between said two building structures and having a first side edge portion thereof secured to a second one of said two building structures and a second side edge portion thereof slidably disposed within said cavity so as to cover said gap defined between said two building structures under expansion and contraction conditions; and
channel means provided upon said cover frame member for housing a side edge portion of said building panel in order to mount said building panel upon said one of said two building structures.

7. An expansion joint as set forth in claim 6, further comprising:
bracket means fixedly secured to said second one of said two building structures and having a male connecting means formed upon a free end portion thereof; and
said expansion joint covering plate has a female connecting means formed upon said first side edge portion thereof for matingly engaging said male connecting means of said bracket means so as to secure said expansion joint covering plate to said second one of said two building structures.

8. An expansion joint as set forth in claim 7, wherein:
said male connecting means of said bracket means has a beaded edge type configuration; and
said female connecting means of said expansion joint covering plate comprises a substantially C-shaped socket member pivotably housing said beaded edge portion of said male connecting means.

9. An expansion joint as set forth in claim 7, wherein:
said bracket means has a substantially L-shaped configuration.

10. An expansion joint as set forth in claim 6, wherein:
said first and second building structures have surfaces, upon which said base frame member and said first side edge portion of said expansion joint covering plate are secured, which are disposed in orthgonal planes with respect to each other.

11. An expansion joint as set forth in claim 6, further comprising:
first flange means provided upon said base frame member so as to project outwardly away from said first one of said two building structures;
second flange means provided upon said cover frame member so as to be disposed opposite said first flange means of said base frame member and project toward said first one of said two building structures so as to define with said first flange means of said base frame member a slit gap within which said second side edge portion of said expansion joint covering plate is slidably disposed; and
third flange means provided upon said second side edge portion of said expansion joint covering plate for engaging at least one of said first and second flange means of said base frame member and said cover frame member so as to retain said second side edge portion of said expansion joint covering plate within said cavity.

12. An expansion joint as set forth in claim 6, wherein:
said building panel comprises building material means for forming an interior wall panel to be used within said building structure.

13. An expansion joint as set forth in claim 6, wherein:
said channel means of said cover frame member has a substantially C-shaped configuration in cross-section.

* * * * *